US006932226B2

(12) United States Patent
Hardy

(10) Patent No.: US 6,932,226 B2
(45) Date of Patent: Aug. 23, 2005

(54) SHELF RAIL CLIP AND SHELF DISPLAY SYSTEM

(75) Inventor: Stephen Neal Hardy, Wadsworth, OH (US)

(73) Assignee: RTC Industries, Inc., Rolling Meadows, IL (US)

( * ) Notice: Subject to any disclaimer, the term of this patent is extended or adjusted under 35 U.S.C. 154(b) by 34 days.

(21) Appl. No.: 10/410,922

(22) Filed: Apr. 10, 2003

(65) Prior Publication Data

US 2004/0200793 A1 Oct. 14, 2004

(51) Int. Cl.[7] ..... A47F 5/00

(52) U.S. Cl. ..... 211/119.003; 211/86.01; 40/611.01; 40/661.03; 248/225.11; 248/222.11

(58) Field of Search ..... 211/119.003, 192, 211/94.01, 184, 86.01; 40/661.03, 611.01; 403/315, 319, 320; 248/221.11, 222.11, 222.13, 223.41, 229.11, 225.11

(56) References Cited

U.S. PATENT DOCUMENTS 3,552,702 A * 1/1971 Springer ..... 248/316.7
3,680,711 A * 8/1972 Brucker ..... 211/105.3
4,406,374 A * 9/1983 Yedor ..... 211/192
4,506,856 A * 3/1985 Rich et al. ..... 248/220.31
4,805,331 A * 2/1989 Boggess et al. ..... 40/651
4,869,378 A * 9/1989 Miller ..... 211/94.01
4,909,464 A * 3/1990 Levine et al. ..... 248/220.22
5,788,192 A * 8/1998 Poole, Jr. ..... 248/49
6,012,244 A * 1/2000 Begum et al. ..... 40/661.03
6,354,546 B1 * 3/2002 Mueller ..... 248/220.42
6,698,124 B2 * 3/2004 Kump et al. ..... 40/642.02
2002/0104246 A1 * 8/2002 Reynolds ..... 40/642.02

* cited by examiner

*Primary Examiner*—Robert W. Gibson, Jr.
(74) *Attorney, Agent, or Firm*—Banner & Witcoff, LTD

(57) ABSTRACT

An attachment device for attachment to a shelf rail having a slot and an upper cavity. The attachment device includes an upper shelf rail insert for insertion into the slot, and a lower shelf rail insert for insertion into the slot beneath the upper shelf rail insert. The upper shelf rail insert has an upper lip for insertion into the upper cavity of the shelf rail. The present invention also provides a shelf display system having a shelf rail and a shelf rail clip. The shelf rail may have a female dovetail or semi-dovetail configuration. The shelf rail clip includes upper and lower shelf rail inserts that may have a male dovetail or semi-dovetail configuration for coupling the shelf rail clip to the shelf rail.

19 Claims, 4 Drawing Sheets

FIG.7A
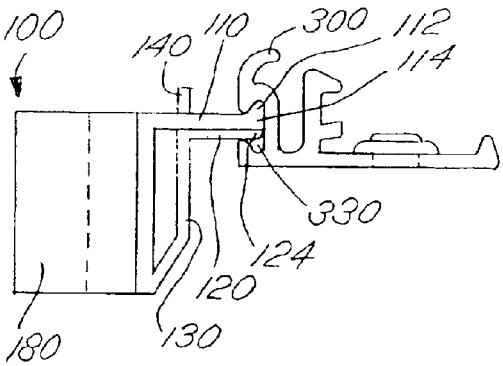
FIG.7B
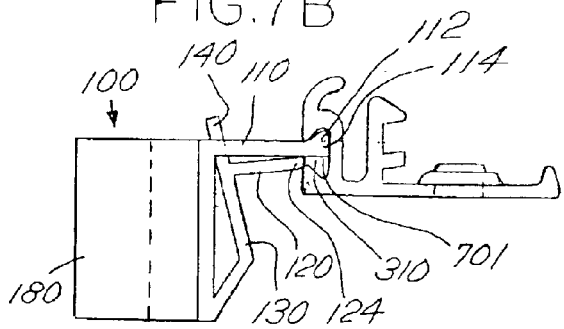
FIG.7C
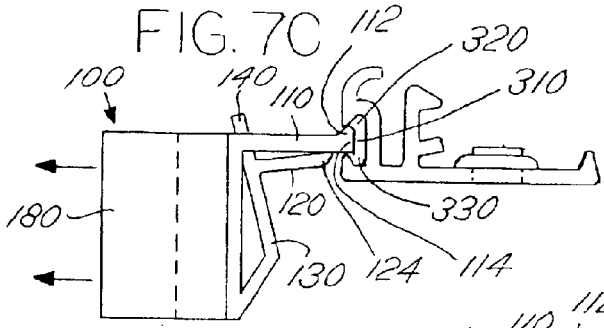
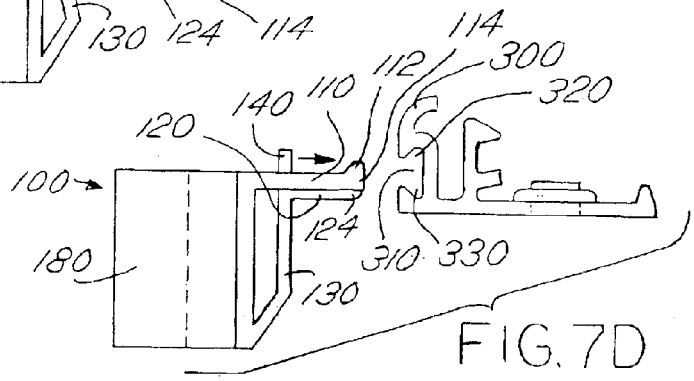
FIG.7D
FIG.8A
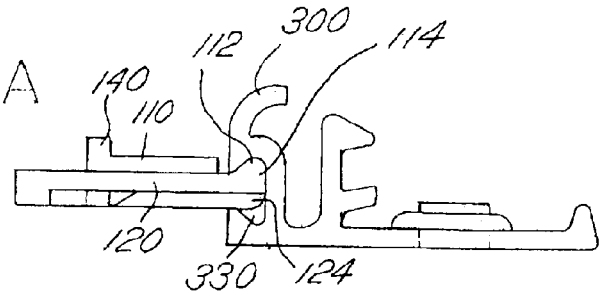
FIG 8B
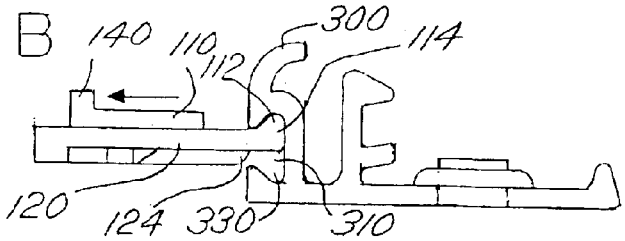

SHELF RAIL CLIP AND SHELF DISPLAY SYSTEM

BACKGROUND OF THE INVENTION

The present invention relates generally to an attachment device, shelf rail clip, and shelf management and display system.

A widely used shelf management system in retail stores includes a front rail that attaches to the top front edge of a merchandising shelf. This shelf rail is the basis for a shelf management system that organizes product on the shelf. A dovetail slot and cavity generally run the length of the shelf rail. The shelf rail, in turn, typically runs the length of the merchandising shelf.

A retailer may desire to attach various objects, such as signage and coupon dispensers, to the front edge of the shelf or the shelf rail. At present, mechanisms allowing a retailer to attach various objects to such shelf rails have significant shortcomings. For example, a shelf rail mounting device may be designed with a male dovetail section that matches the dovetail cavity of the shelf rail. The retailer may then couple the mounting device to the shelf rail by inserting the male dovetail section into an open end of the shelf rail dovetail cavity and then sliding the mounting device to the desired location along the shelf rail. One shortcoming of such a shelf rail mounting device is that often the open ends of the shelf rail are not readily accessible. The retailer must either move the shelf to allow the insertion of the mounting device in an uncovered open end of the shelf rail. Another shortcoming of such a mounting device is that the shelf rail of interest is often already populated with other mounted objects, such as signs, displays, and price numbers, which interfere with sliding the mounting device to the desired position along the shelf rail.

In another design, a shelf rail mounting device may include a male dovetail section that is made from a compressible material. A retailer may insert and remove such a mounting device by compressing the compressible male dovetail section and forcing the compressed male dovetail section into the shelf rail dovetail cavity. While such a mounting device provides for direct insertion of the mounting device into the shelf rail at a desired location, the mounting device suffers from deficiencies due to the compressible material. Such deficiencies include limited lifespan of the mounting device due to wear and tear of the compressible material, and limited coupling strength between the mounting device and the shelf rail, which allows mounted devices that are inadvertently bumped to become disengaged from the shelf rail.

Thus, the need exists for a shelf mounting device that provides for easy attachment of the shelf mounting device to a shelf rail at a desired location and provides a strong coupling between the shelf mounting device and the shelf rail.

SUMMARY OF THE INVENTION

The present invention provides an apparatus for convenient and strong attachment of a shelf mounting device to a shelf rail at a desired location along the shelf rail. The present invention also provides a shelf display system incorporating a shelf rail and a shelf mounting device.

An aspect of the present invention provides an attachment device, such as a shelf rail clip for coupling to a shelf rail having a slot that may be in a female dovetail or semi-dovetail configuration. Such a shelf rail has at least a slot and an upper cavity. The shelf rail clip includes an upper shelf rail insert for insertion into the shelf rail slot, and a lower shelf rail insert for insertion into the shelf rail slot beneath the upper shelf rail insert.

Another aspect of the present invention provides a shelf display system. The shelf display system includes a shelf rail having a slot that may be in a dovetail or semi-dovetail configuration. The shelf display system further includes a shelf rail clip coupled to the shelf rail.

BRIEF DESCRIPTION OF THE SEVERAL VIEWS OF THE DRAWINGS

FIG. 7 illustrates the process of decoupling a shelf rail clip from a shelf rail.

FIG. 8 illustrates an operational relationship between an upper shelf rail insert and a lower shelf rail insert of a shelf rail clip.

DETAILED DESCRIPTION OF ASPECTS OF THE INVENTION

In the following detailed description, spatially orienting terms are used, such as "upper," "lower," "left," "right," "vertical," "horizontal," and the like. It is to be understood that these terms are used for convenience of description of aspects of the invention by reference to the drawings. These terms do not necessarily describe the absolute location in space, such as left, right, upward, downward, etc., that any part must assume.

Figure 1:
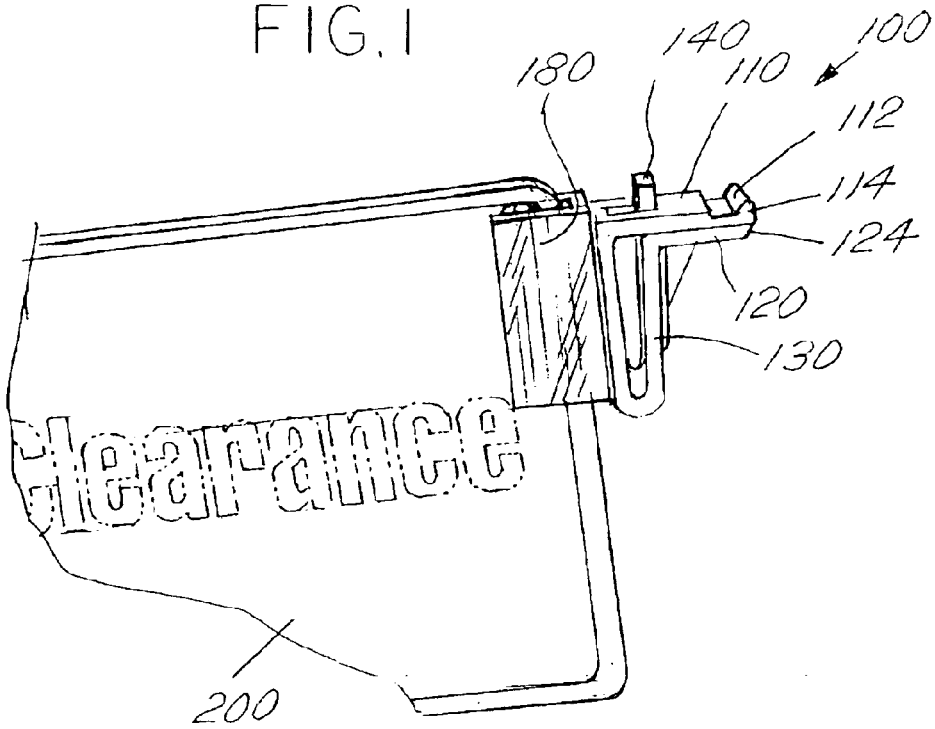
FIG. 1 shows a side view of a shelf rail clip holding a sign.
Figure 2:
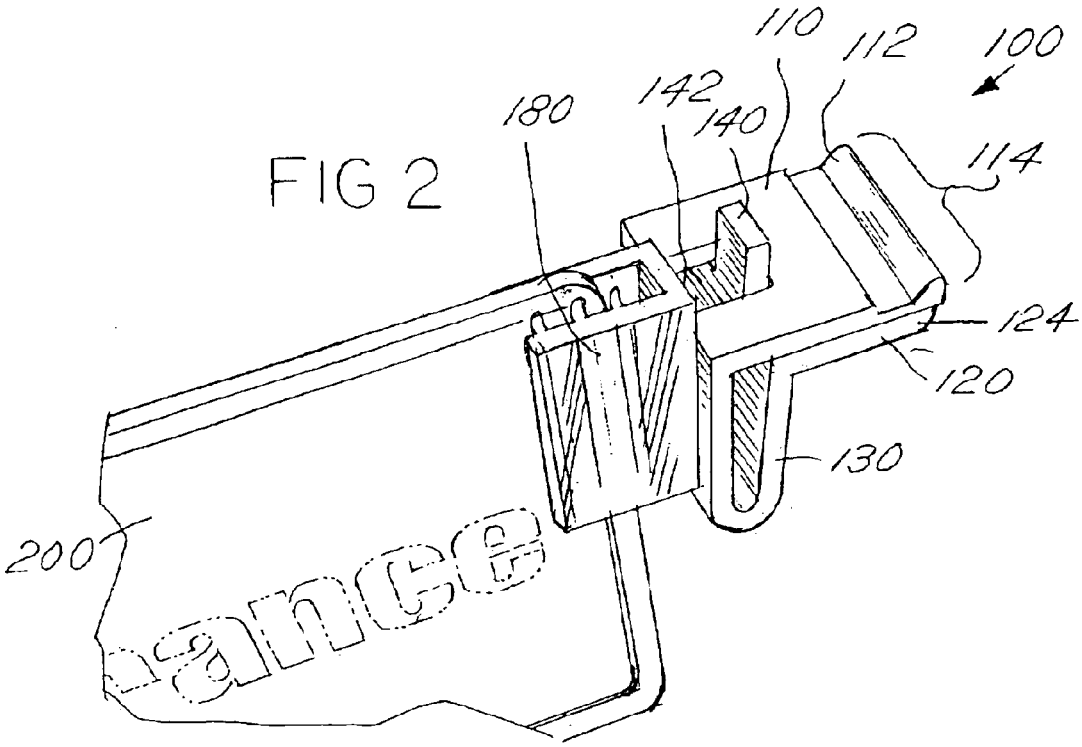
FIG. 2 shows a perspective view of a shelf rail clip holding a sign.

FIGS. 1 and 2 show side and perspective views, respectively, of one embodiment of an attachment device in the shape of a shelf rail clip 100. The shelf rail clip 100 is illustrated holding a sign card 200. The shelf rail clip 100 includes an upper shelf rail insert 110 and lower shelf rail insert 120.

The upper shelf rail insert 110 includes an upper lip 112 disposed near the insertion end 114 of the upper shelf rail insert 110. The upper lip 112 extends generally upward from the upper shelf rail insert 110.

The lower shelf rail insert 120 is disposed adjacent to and beneath the upper shelf rail insert 110. The upper surface of the lower shelf rail insert 120 preferably movably engages the lower surface of the upper shelf rail insert 110. The lower shelf rail insert 120 includes an insertion end 124 generally aligned with the insertion end 114 of the upper shelf rail insert 110. The lower shelf rail insert 120 is illustrated in a substantially flat configuration. The upper and lower shelf rail inserts 110, 120 may alternatively assume other configurations. For example, the lower shelf rail insert 120 may include a lower lip disposed near the insertion end 114, or the insertion end 114 of the lower shelf rail insert 120 may be beveled. The lower shelf rail insert 120 may be a separate piece-part from the upper shelf rail insert 110 or may be integrally formed with or molded in the same piece-part as the upper shelf rail insert 110.

In one embodiment of the invention, a spring member 130 is coupled to the lower shelf rail insert 120. The spring member 130 may be disposed to encourage alignment of the insertions ends 114, 124 of the upper and lower shelf rail inserts 110, 120. The spring member 130 illustrated in FIGS. 1 and 2 includes a cantilever-type spring mechanism but may, of course, include other well-known spring configurations. The spring member 130 may be a separate piece-part from the lower shelf rail insert 120 or may be integrally formed with or molded in the same piece-part as the lower shelf rail insert 120.

In one embodiment, the shelf rail clip 100 includes an operating tab 140 coupled to the lower shelf rail insert 120. The operating tab 140 provides a convenient mechanism by which an operator may move the lower shelf rail insert 120 relative to the upper shelf rail insert 110. The operating tab 140 may extend upward through an operating tab opening 142 in the upper shelf rail insert 110. The operating tab 140 may be a separate piece-part from the lower shelf rail insert 120 or may be integrally formed with or molded in the same piece-part as the lower shelf rail insert 120. Similarly, the operating tab opening 142 may be molded as part of the upper shelf rail insert 110 or may be cut into the upper shelf rail insert 110.

The shelf rail clip 100 may have a display holding member 180 coupled thereto. The display holding member 180 may be configured to hold various display objects, such as, for example, sign cards, advertisements, coupon dispensers, and hanging product racks. The display holding member 180 may be a separate piece-part coupled to the shelf rail clip 100 or may be integrally formed with or molded in the same piece-part(s) as the shelf rail clip 100.

Figure 3:
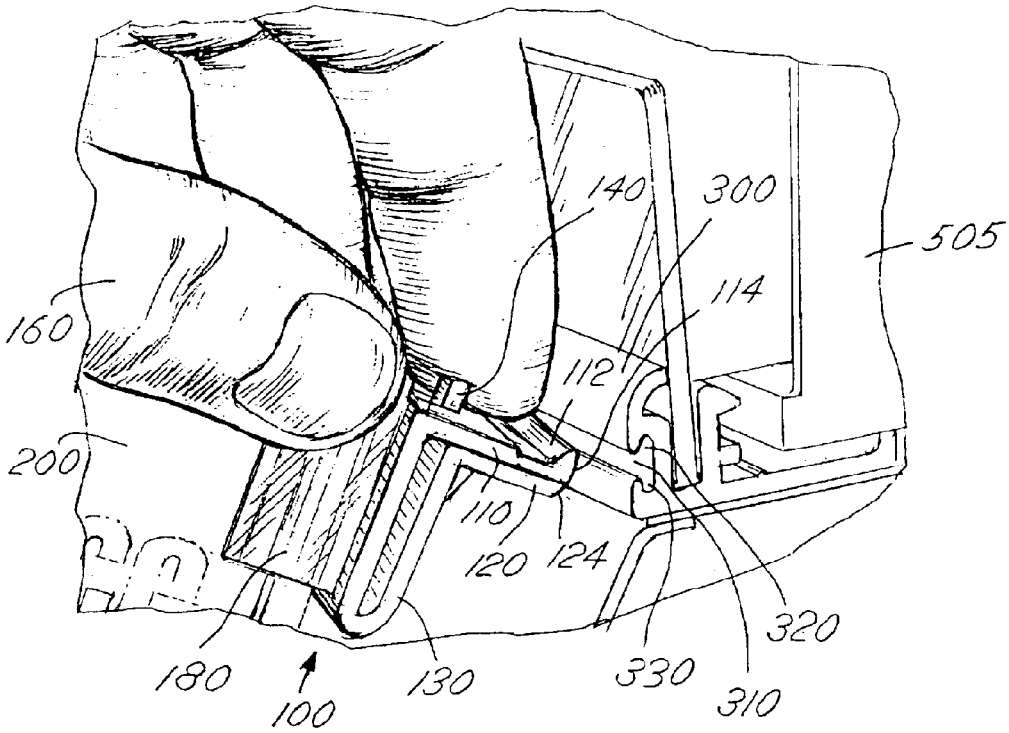
FIG. 3 shows an operator coupling a shelf rail clip to a shelf rail.

FIG. 3 shows an operator 160 inserting a shelf rail clip 100 into a shelf rail 300. The shelf rail 300 includes a dovetail slot 310 running along the front surface of the shelf rail 300 and typically running the length of the shelf rail 300. The shelf rail 300 also includes an upper dovetail cavity 320 and a lower dovetail cavity 330. The dovetail cavities 320, 330 typically may run the length of a shelf rail 300.

The operator 160 couples the shelf rail clip 100 to the shelf rail 300, in one embodiment of the invention, by inserting the insertion end 114 of the upper shelf rail insert 110 into the dovetail slot 310. The operator positions the upper lip 112 of the upper shelf rail insert 110 into the upper dovetail cavity 320 of the shelf rail 300. During the coupling process, the operator may work the operating tab 140 to move the lower shelf rail insert 120 to a non-interfering position, but this is generally not required. Force applied by the outer surface of the shelf rail 300 on the insertion end 124 of the lower shelf rail insert 120 will generally be sufficient to move the lower shelf rail insert 120 to a non-interfering position during insertion of the upper shelf rail insert 120 into the dovetail slot 310.

Figure 4:
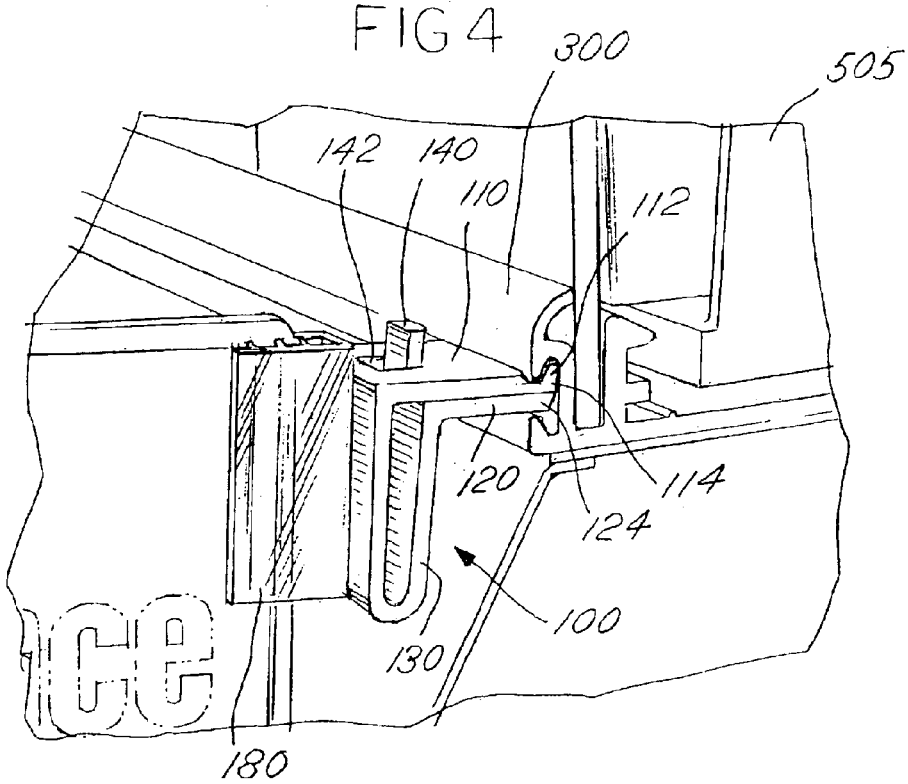
FIG. 4 shows a shelf rail clip and sign coupled to a shelf rail.

After the operator has positioned the upper lip 112 into the upper dovetail cavity 320, the operator positions the shelf rail clip 100 into the position illustrated in FIG. 4. If the operator is working the operating tab 140 during the coupling process, upon shifting the shelf rail clip 100 into the desired position, the operator works or releases the operating tab to position the insertion end 124 of the lower shelf rail insert 120 in the dovetail slot 310 beneath the upper shelf rail insert 110. When the shelf rail clip 100 is coupled to the shelf rail 300 oriented as shown in FIG. 4, the coupling between the shelf rail clip 100 and the shelf rail 300 is strong and not easily decoupled inadvertently.

Figure 5:
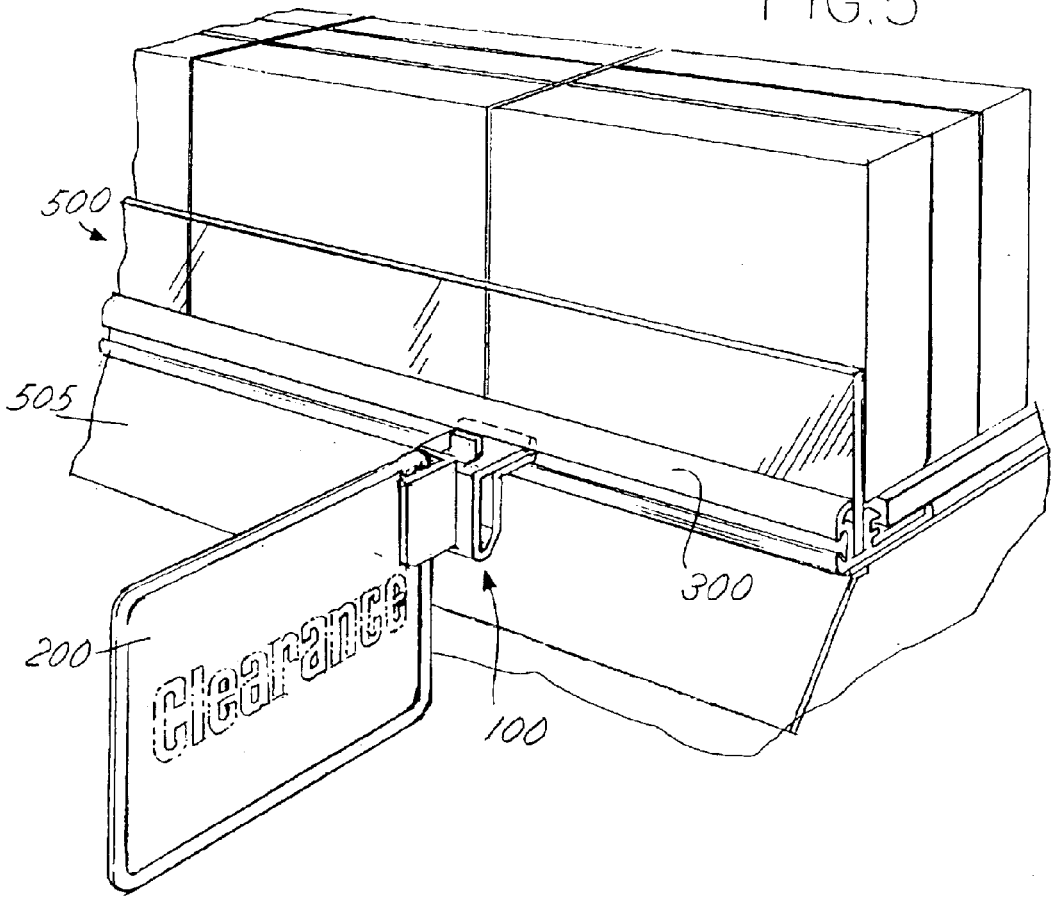
FIG. 5 shows a perspective view of a shelf rail clip and sign coupled to a shelf rail.

FIG. 5 shows a perspective view of one embodiment of the shelf rail clip 100 as a component of a shelf system 500. The shelf system 500 includes at least one shelf 505. The shelf rail clip 100, holding a sign card 200, is coupled to the shelf rail 300. The shelf rail 300 is, in turn, coupled to the shelf 505.

Figure 6:
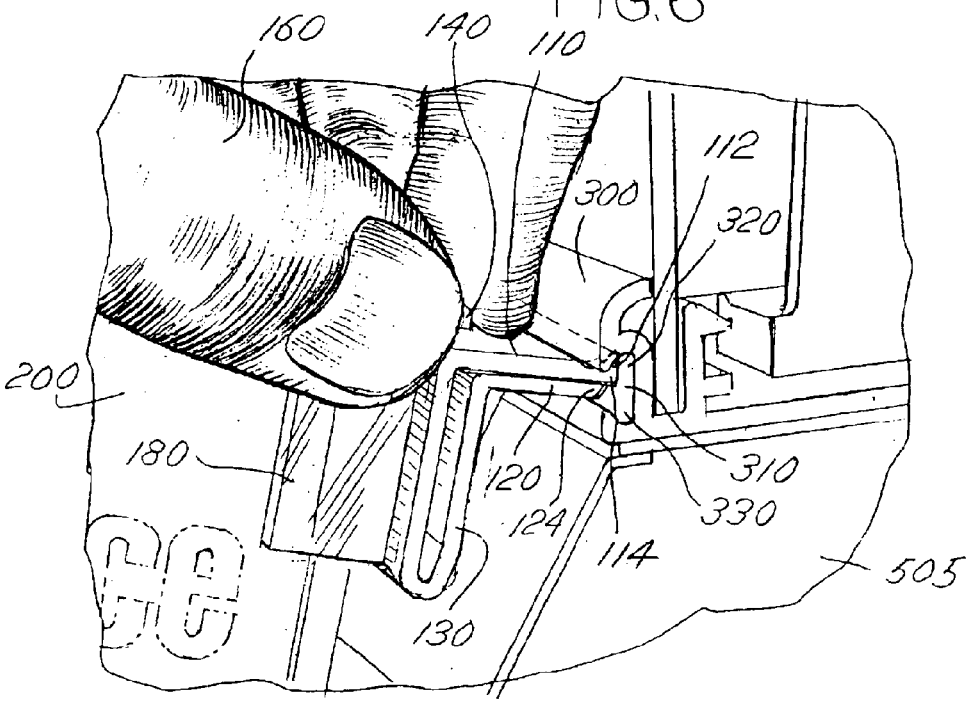
FIG. 6 shows an operator decoupling a shelf rail clip from a shelf rail.

FIG. 6 generally shows an operator 160 decoupling the shelf rail clip 100 of one embodiment of the invention from a shelf rail 300, and FIG. 7 illustrates a step-by-step process for such removal. With reference to FIG. 7, FIG. 7A is a side view of the shelf rail clip 100 securely coupled to the shelf rail 300. To loosen the coupling between the shelf rail clip 100 and the shelf rail 300, the operator works the operating tab 140 to remove the lower shelf rail insert 120 from the dovetail slot 310. See FIG. 7B. This removal provides vacated space 701 in the dovetail slot 310 beneath the upper shelf rail insert 110. The operator then removes the upper lip 112 of the upper shelf rail insert 110 from the upper dovetail cavity 320. See FIG. 7C. The operator then extracts the upper shelf rail insert 110 from the dovetail slot 310, thereby decoupling the shelf rail clip 100 from the shelf rail 300. See FIG. 7D.

FIG. 8 illustrates the general operational relationship between the upper shelf rail insert 110 and lower shelf rail insert 120 of the shelf rail clip 100.

While aspects of the invention have been described with respect to specific examples including presently preferred modes of carrying out the invention, those skilled in the art will appreciate that there are numerous variations and permutations of the above described apparatus and methods that fall within the spirit and scope of the invention.

What is claimed is:

1. A shelf display system, comprising:

a shelf rail having a slot and an upper cavity; and a shelf rail clip coupled to the shelf rail, the shelf rail clip comprising:

an upper shelf rail insert for insertion into an upper portion of the slot, the upper shelf rail insert having an upper lip that extends into the upper cavity when the upper shelf rail insert is inserted into the upper portion of the slot; and a lower shelf rail insert for insertion into a lower portion of the slot, the lower shelf rail insert movably engaging the upper shelf rail insert, the lower shelf rail insert coupled to an operating tab.

2. The shelf display system of claim 1, wherein the slot has a dovetail shape.

3. The shelf display system of claim 1, where the shelf rail clip further comprises a spring member disposed to bias the relative position between the upper and lower shelf rail inserts.

4. The shelf display system of claim 3, wherein the upper shelf rail insert comprises an operating tab opening through which the operating tab extends.

5. The shelf display system of claim 1, wherein the shelf rail clip consists of a single molded piece-part.

6. An attachment device comprising:

an upper engaging member;

a lower engaging member in movable contact with the upper engaging member;

a spring coupled to the lower engaging member; and a display-holding member coupled to at least one of the upper and lower engaging members, wherein the upper engaging member is configured to resist, during operation, a moment exerted on the attachment device by the weight of a display supported by the display-holding member when the upper engaging member is engaged with a shelf rail.

7. An attachment device comprising:

an upper engaging member;

a lower engaging member in movable contact with the upper engaging member;

a spring coupled to the lower engaging member; and a display-gripping member coupled to at least one of the upper and lower engaging members.

8. An attachment device comprising:

an upper engaging member;

a lower engaging member in movable contact with the upper engaging member;

a spring coupled to the lower engaging member;

a display-holding member coupled to at least one of the upper and lower engaging members; and a lip on the upper engaging member, the lip located substantially near an end of the upper engaging member.

9. An attachment device comprising:

an upper engaging member;

a lower engaging member in movable contact with the upper engaging member;

a spring coupled to the lower engaging member;

a display-holding member coupled to at least one of the upper and lower engaging members; and a lip on the lower engaging member, the lip located substantially near an end of the lower engaging member.

10. The attachment device of claim 6, wherein the display-holding member is configured to substantially restrain the display so as to substantially remove at least one degree of freedom.

11. A shelf rail clip comprising:

an upper shelf rail insert;

a lower shelf rail insert that movably engages the upper shelf rail insert, the lower shelf rail insert coupled to an operating tab; and a lip disposed proximate to an end of at least one of the upper and lower shelf rail inserts.

12. The shelf rail clip of claim 11, wherein the upper shelf rail insert comprises an operating tab opening through which the operating tab extends.

13. The shelf rail clip of claim 11, further comprising a spring member disposed to bias the relative position between the upper and lower shelf rail inserts.

14. The shelf rail clip of claim 13, wherein the spring member includes a cantilever-type spring.

15. The shelf rail clip of claim 14, further comprising an operating tab coupled to the lower shelf rail insert, and wherein the upper shelf rail insert comprises an operating tab opening through which the operating tab extends.

16. The shelf rail clip of claim 15, wherein the shelf rail clip consists of a single molded piece-part.

17. The shelf rail clip of claim 11, further comprising a display-holding member coupled to the upper shelf rail insert.

18. The shelf rail clip of claim 17, wherein the shelf rail clip consists of a single molded piece-part.

19. The shelf rail clip of claim 11 , wherein the lower shelf rail insert is substantially flat.

* * * * *